US006093916A

United States Patent [19]

Toyoizumi

[11] Patent Number: 6,093,916

[45] Date of Patent: Jul. 25, 2000

[54] CONTROL DEVICE WITH FIRST AND SECOND POWER CONTROL ELEMENTS TO CONTROL HEATER DRIVE APPARATUS

[75] Inventor: Kiyoto Toyoizumi, Odawara, Japan

[73] Assignee: Canon Kabushiki Kaisha, Tokyo, Japan

[21] Appl. No.: 09/163,400

[22] Filed: Sep. 30, 1998

[30] Foreign Application Priority Data

Oct. 6, 1997 [JP] Japan ..... 9-289171
Dec. 29, 1997 [JP] Japan ..... 9-369123

[51] Int. Cl.[7] ..... H05B 1/02

[52] U.S. Cl. ..... 219/501; 219/485; 219/486; 307/29

[58] Field of Search ..... 219/501, 497, 219/216, 481, 330, 494, 506, 486, 485; 307/29, 38, 39

[56] References Cited

U.S. PATENT DOCUMENTS 3,961,236 6/1976 Rodek et al. ..... 323/18
4,564,748 1/1986 Gupton ..... 219/497
4,617,453 10/1986 Kumon ..... 219/501
4,638,147 1/1987 Dytch et al. ..... 392/485
4,798,927 1/1989 Kaminaka ..... 219/685
4,912,300 3/1990 Hennuy et al. ..... 392/365
5,670,832 9/1997 Takeda ..... 307/39
5,756,969 5/1998 Machino et al. ..... 219/497
5,760,494 6/1998 Takeda ..... 307/39
5,802,421 9/1998 Miura ..... 399/33
5,875,373 2/1999 Sato et al. ..... 399/68
5,920,366 7/1999 Dehmlow et al. ..... 349/161

*Primary Examiner*—Teresa Walberg
*Assistant Examiner*—Jeffrey Pwu
*Attorney, Agent, or Firm*—Fitzpatrick, Cella, Harper & Scinto

[57] ABSTRACT

The present invention relates to driving of a heater of a fixing unit in an image process apparatus. In case of driving first and second heaters by using a constant voltage output control circuit, when the first or second heater is switched from an ON state to an OFF state, an operation of the constant voltage output control circuit is stopped, thereby preventing destruction of circuit elements. Also, when the first heater is in the ON state and the second heater is switched from the OFF state to the ON state, the operation of the constant voltage output control circuit is stopped.

7 Claims, 9 Drawing Sheets

142
NOISE FILTER
141
120
103
123
118
121
125
Vcc
Vcc
Vsense
Iac
Vrms
Mult
Out
GT
Drv
ENA
SS
Gnd
121-a
PC2
106B
101
143
121-b
121-c
121-d
126
124
117
140
137
122
Vcc
133
119
Vcc
136
135
132
131
139
PC1
134
138
130B
+5V
129
110
+5V
114
PC1
PC2
106A
130A
127
Vcc
A/D
115
P1
128
P2
112
MPU
P3
GND
144
116
146
145
MOTOR
MOTOR DRIVER CKT

CONTROL DEVICE WITH FIRST AND SECOND POWER CONTROL ELEMENTS TO CONTROL HEATER DRIVE APPARATUS

BACKGROUND OF THE INVENTION

1. Field of the Invention

The present invention relates to a control device of a heater drive apparatus which heats an object.

2. Related Background Art

In a conventional electrophotographic-system image process apparatus, a control device of a heater drive apparatus supplies constant power to a heater in spite of voltage variation of an A/C power supply such that the power consumed by the heater is always kept constant, thereby preventing overshoot and ripple of heater surface temperature. For this reason, a constant voltage output circuit is provided in the heater.

Further, in a case where the image process apparatus uses a halogen heater as a heat source and a lighting fixture to which power is supplied from the same outlet as that for the image process apparatus exists, a flicker phenomenon such as flickering of the lighting fixture or the like occurs since a rapid current fluctuation at the time of turn on/off of the halogen heater occurs depending on a certain power supply impedance. In order to prevent such the phenomenon, an output from the constant voltage output circuit is gradually raised and fallen in a certain time constant to eliminate the rapid current fluctuation.

Furthermore, in a case where plural heaters are connected to one constant voltage output circuit, when a part or all of the plural heaters being in an OFF state are turned on, or on the contrary when the part or all of the heaters in an ON state are turned off, the rapid current fluctuation is eliminated by gradually raising or falling the output from the constant voltage output circuit in the certain time constant.

However, in case of switching or changing connection of a power switch, an excessive voltage is generated due to counter-electromotive force of an inductor, whereby there is some fear that circuit elements are destroyed. In order to prevent such destruction, it is required to perform the switching always after confirming that the output voltage from the constant voltage output circuit once comes to have a value equal to or lower than a predetermined value or after elapsing a sufficient period of time.

Further, a long period of time is necessary until the heater is warmed up.

SUMMARY OF THE INVENTION

An object of the present invention is to provide control device and method of a heater drive apparatus which can prevent destruction of circuit elements.

An another object of the present invention is to provide control device and method of the heater drive apparatus which can shorten a starting-up time of a fixing heater and also suppress an increase in power consumption.

A still another object of the present invention is to provide control device and method of the heater drive apparatus which can suppress a flicker phenomenon of a lighting fixture.

Other objects of the present invention will become apparent from the following description based on the accompanying drawings and the appended claims.

DETAILED DESCRIPTION OF THE PREFERRED EMBODIMENTS

Figure 1:
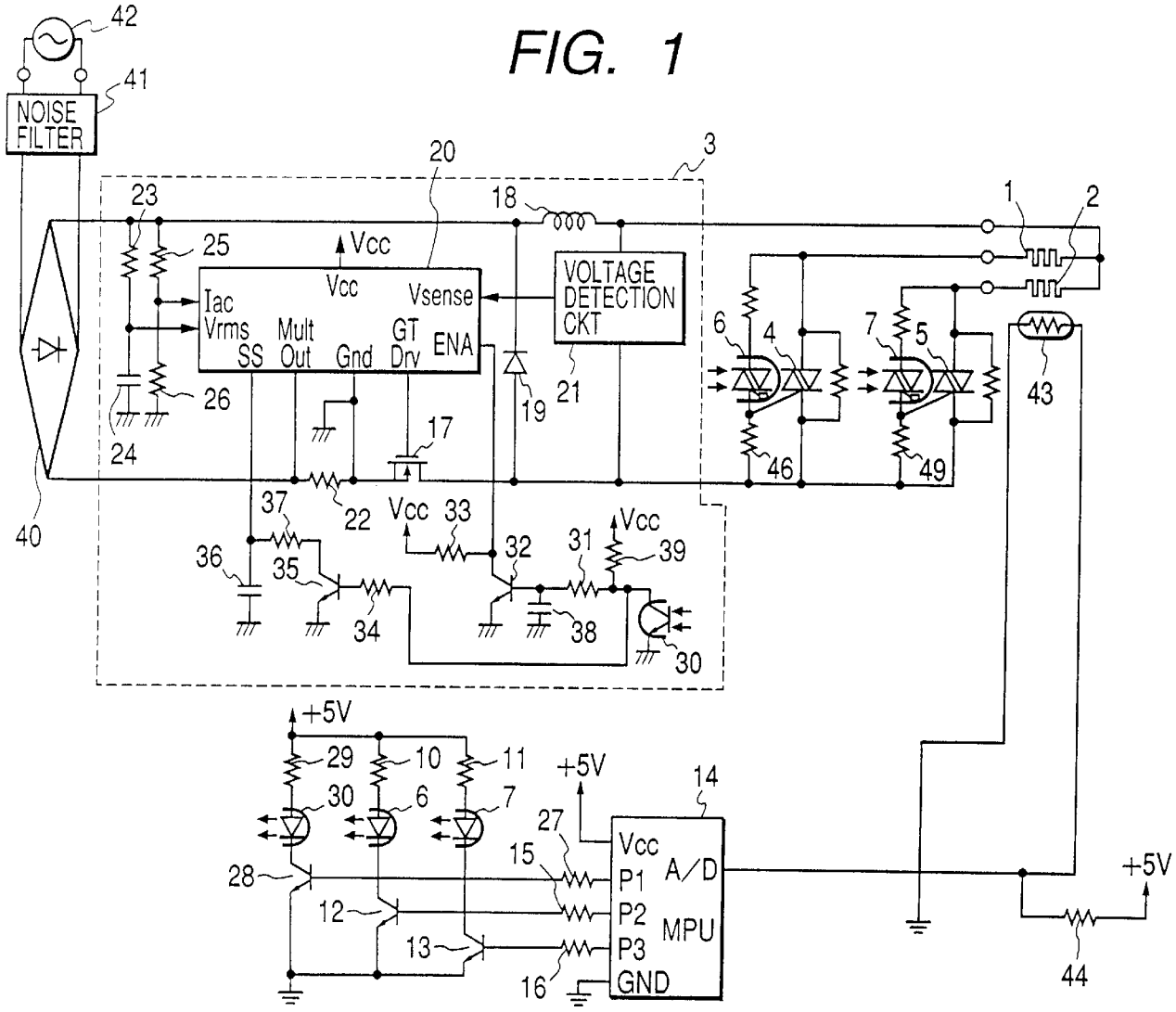
FIG. 1 is a circuit diagram of a control device of a heater drive apparatus according to embodiments of the present invention.

Hereinafter, a structure of a control device of a heater drive apparatus according to the embodiments of the present invention will be described with reference to FIG. 1. FIG. 1 is a circuit diagram showing the control device of the heater drive apparatus according to the embodiments of the present invention.

In FIG. 1, halogen heaters 1 and 2 are provided in a not-shown thermal fixing apparatus such as a copy machine, a laser printer or the like, and connected to a later-described constant voltage output circuit 3 through TRIACs (triode AC switches) 4 and 5. Power is supplied to the halogen heaters 1 and 2 from the constant voltage output circuit 3 acting as a power supply means. Then, when the TRIACs 4 and 5 come to be in a conductive state, the halogen heaters 1 and 2 emit light.

Gates of the TRIACs 4 and 5 are connected to photo-TRIAC sides of photo-TRIAC couplers 6 and 7 and resistors 46 and 49, respectively. On the other hand, anodes at photodiode sides of the photo-TRIAC couplers 6 and 7 are connected to a power supply of +5V respectively through resistors 10 and 11. Cathodes at the photodiode sides are connected to transistors 12 and 13 respectively. Digital output ports P2 and P3 in a MPU 14, which has a timer, a ROM, a RAM, each input/output port and the like (all not shown) and performs lighting control of the heaters, are connected to bases of transistors 12 and 13 through resistors 15 and 16 respectively. When the MPU 14 sets the output ports P2 and P3 to be in a HIGH level, the transistors 12 and 13 are turned on, the photodiode sides of the photo-TRIAC couplers 6 and 7 are turned on, and then the photo-TRIAC sides are turned on, whereby gate potential of the TRIACs 4 and 5 are raised. Thus, the TRIACs 4 and 5 become conductive, the halogen heaters 1 and 2 are connected to the constant voltage output circuit 3, and the heaters emit light. As described later, such types of the photo-TRIAC couplers 6 and 7 as involving a zero-crossing are used.

The constant voltage output circuit 3 is connected to a commercial power supply 42 through a diode bridge 40 and a noise filter 41. The constant voltage output circuit 3, which includes a chopping FET 17, an inductor 18 and a snubber diode 19, forms a voltage dropping type DC/DC converter.

A voltage detection circuit 21 detects an output voltage from the constant voltage output circuit 3. An output current from the constant voltage output circuit 3 is detected by a current detection resistor 22. An input effective value voltage is detected by a resistor 23 and a capacitor 24. An input voltage waveform is detected by resistors 25 and 26. A control IC 20 controls a duty of the chopping FET 17 repeating on and off at cycle of about 100 KHz such that the output voltage from the constant voltage output circuit 3 becomes constant or that an output current waveform and the input voltage waveforms become similar. As the control IC 20, there has been known "UC3854" manufactured by UNITRODE.

Subsequently, the MPU 14 detects a temperature of the thermal fixing apparatus by using a thermistor 43 and a resistor 44 being temperature detection elements. The temperature of the thermal fixing apparatus is set to reach a target value by controlling the connection between the constant voltage output circuit 3 and the halogen heaters 1 and 2 on the basis of the detected temperature.

The MPU 14 acting as a control means controls the output voltage by setting a digital output port P1 to be a HIGH level. When the digital output port P1 becomes the HIGH level, a transistor 28 is turned on through a resistor 27. Then, a photodiode of a photocoupler 30 connected to a power supply of +5V through a pull-up resistor 29 is turned on. After then, a phototransistor of the photocoupler 30 is turned on and a transistor 32 is turned off through a resistor 31. Therefore, a power supply voltage (Vcc) is inputted to an enable terminal (ENA) of the control IC 20 through a resistor 33 to operate the control IC 20, thereby controlling the output voltage. When the phototransistor of the photocoupler 30 is turned on, a transistor 35 is simultaneously turned off through a resistor 34, and a capacitor 36 connected to a soft start terminal (SS) of the control IC 20 is charged to gradually raise potential in the soft start terminal (SS). Therefore, an output voltage value of the constant voltage output circuit 3 is also raised in a certain time constant.

On the contrary, when the phototransistor of the photocoupler 30 is turned off, the transistor 35 is turned on. Then, an electric charge in the charged capacitor 36 is discharged through a resistor 37. Therefore, the potential in the soft start terminal (SS) is gradually fallen and the output voltage value of the constant voltage output circuit 3 is also fallen in a certain time constant.

A capacitor 38 connected to a base of the transistor 32 operates such that the transistor 32 used in enable controlling is made to be turned on and off in a certain delay time to the transistor 35 used in soft start controlling when the phototransistor of the photocoupler 30 is turned on and off. A resistor 39 is a pull-up resistor which causes the transistors 32 and 35 to be turned on.

Figure 2:
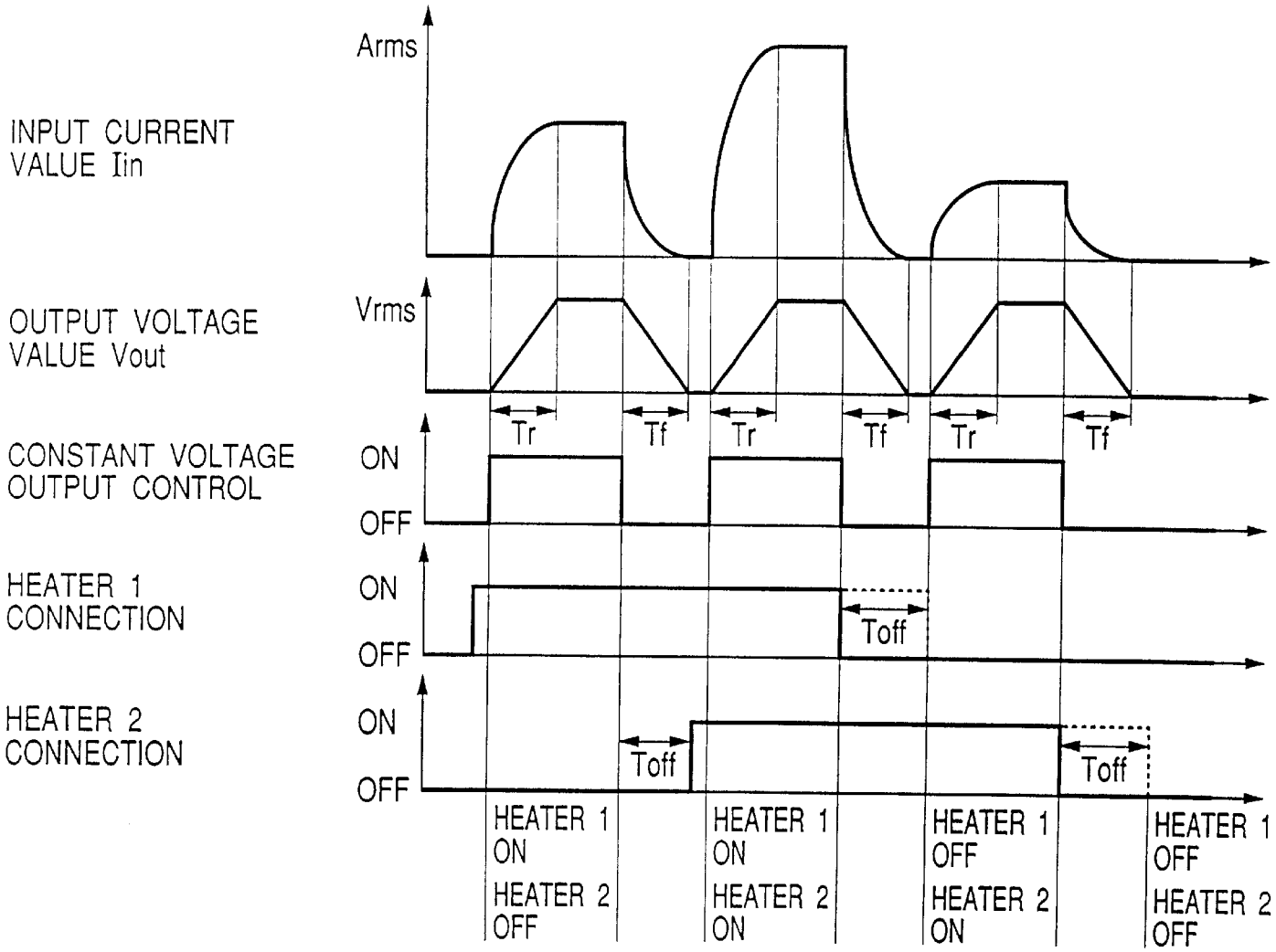
FIG. 2 is a timing chart indicating controlling at a time when halogen heaters 1 and 2 are turned on and off.

Subsequently, controlling at a time when the halogen heaters 1 and 2 are turned on and off will be described with reference to a timing chart shown in FIG. 2. The timing chart in FIG. 2 indicates each controlling, an output voltage value (Vout) of the constant voltage output circuit 3 and an input current value (Iin) from the commercial power supply 42 when only the heater 1 is turned on. Then, the heater 2 is also turned on, only the heater 1 is turned off, and the heater 2 is also turned off from such a state as both the heaters 1 and 2 are in an OFF state.

At first, in a case where only the heater 1 is turned on from such a state as both the heaters 1 and 2 are in the OFF state, the heater 1 is turned on at the same time of starting constant voltage output controlling or before starting the constant voltage output controlling. At this time, since the output voltage value of the constant voltage output circuit 3 is raised in a certain time constant Tr depending on a slow start function after starting the constant voltage output controlling, the input current value is also raised gradually.

Subsequently, in a case where the heater 2 is turned on, the constant voltage output controlling is once stopped. Then, the heater 2 is turned on after the output voltage value of the constant voltage output circuit 3 is fallen in a certain time constant Tf depending on a slowdown function. Timing of turning on the heater 2 is to be set in such a moment as after elapsing a time Toff from when the constant voltage output controlling is stopped until when the output voltage value reaches a predetermined value. It should be noted that since such types of the photo-TRIAC couplers 6 and 7 as involving the zero-crossing can be turned on and off only at a level equal to or smaller than a provided voltage value, precision in managing the time Toff is not required.

Then, the constant voltage output controlling is started again. Similar to the case when only the heater 1 is turned on, since the output voltage value of the constant voltage output circuit 3 is raised in the certain time constant tr depending on the slow start function after starting the constant voltage output controlling, the input current value is also raised gradually. If only the heater 1 is turned off, the constant voltage output controlling is once stopped. Then, the heater 1 is turned off after the output voltage value of the constant voltage output circuit 3 is fallen in the certain time constant Tf depending on the slowdown function. Therefore, it is possible to prevent that the FET 17 and the control IC 20 are destroyed when the heater 1 is in an ON state. Since the TRIACs 4 and 5 can be turned off only at the level equal to or smaller than the provided voltage value, timing controlling of an off-signal is not required.

Subsequently, the constant voltage output controlling is started again. Further, if the heater 2 is turned off, the constant voltage output controlling is once stopped similar to the above case. Then, the heater 2 is turned off after the output voltage value of the constant voltage output circuit 3 is fallen in the certain time constant Tf depending on the slowdown function.

Figure 3:
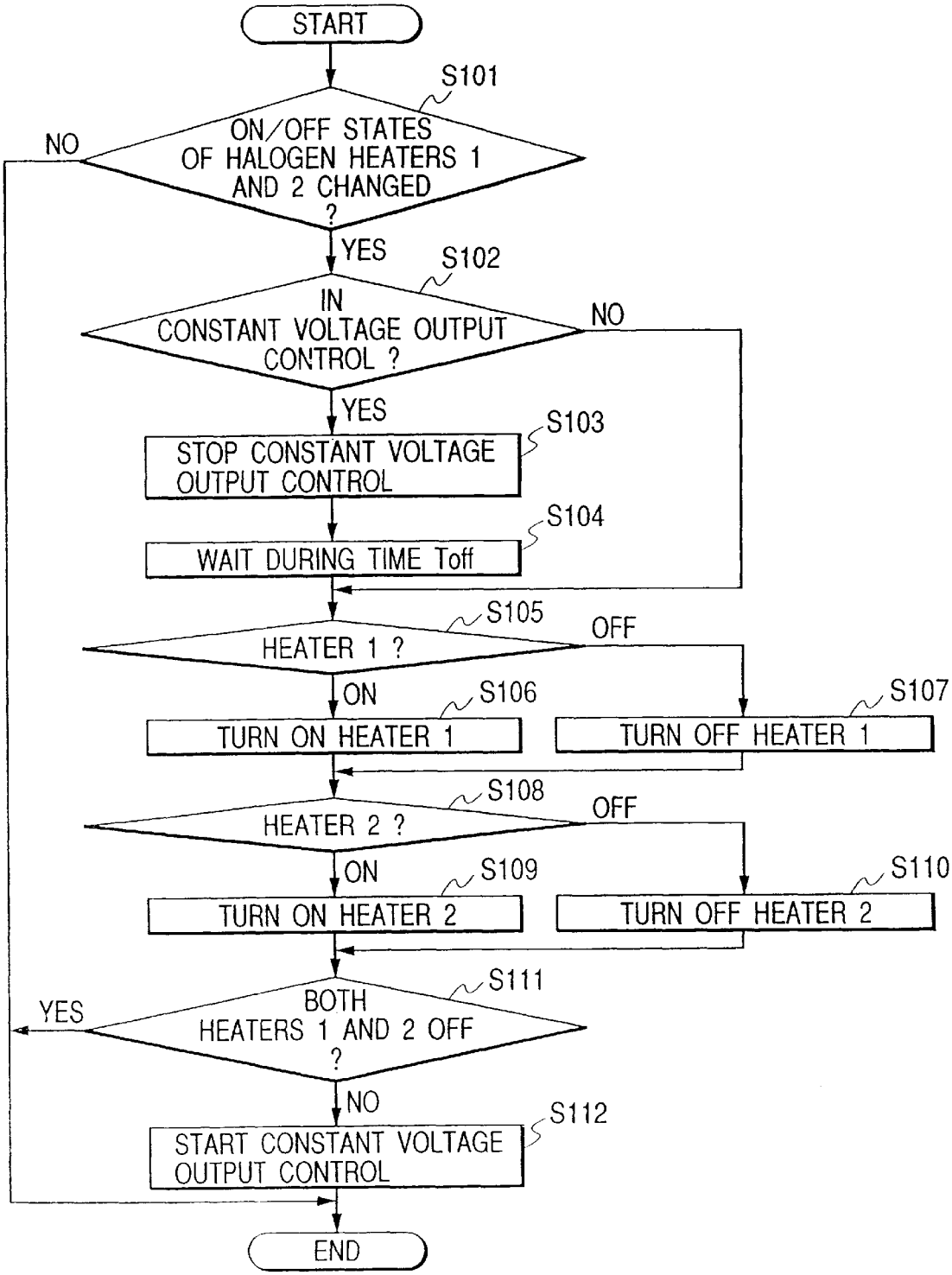
FIG. 3 is a flow chart indicating a control program of the control device of the heater drive apparatus according to the embodiments of the present invention.

FIG. 3 is a flow chart showing a control program of the control device of the heater drive apparatus according to the embodiments of the present invention.

At first, in a step S101, it is discriminated whether or not on/off states of the halogen heaters 1 and 2 are changed in the MPU 14. If not changing, later-described steps S102 to S112 are skipped, and the program terminates. On the other hand, if changing, it is discriminated whether or not the constant voltage output circuit 3 is controlling the constant voltage output in the step S102.

If so in the step S102, the constant voltage output controlling is once stopped (step S103) to wait during the time Toff until when the output voltage value reaches a predetermined value (step S104). Then, a process advances to a step S105. On the other hand, if not in the step S102, the steps S103 and S104 are skipped, and then a process advances to the step S105.

Subsequently, in the step S105, it is discriminated whether the halogen heater 1 is turned on or off by the MPU 14. On the basis of the discriminated result, the halogen heater 1 is turned on (step S106) or off (step S107).

Then, in a step S108, it is discriminated whether the halogen heater 2 is turned on or off by the MPU 14. On the basis of the discriminated result, the halogen heater 2 is turned on (step S109) or off (step S110).

Subsequently, in a step Sill, it is discriminated whether or not both the halogen heaters 1 and 2 have been turned off by the MPU 14. If both the halogen heaters 1 and 2 are not turned off, i.e., if at least one of the heaters 1 and 2 is turned on, the constant voltage output controlling is started (step S112), and the program terminates. On the other hand, if both the heaters 1 and 2 are turned off, the step S112 is skipped, and the program terminates.

As described above, according to the control device of the heater drive apparatus in the embodiment of the present invention, the TRIACs 4 and 5 are provided respectively between the halogen heaters 1 and 2 and the constant voltage output circuit 3. Thus, since the connections between the heaters 1 and 2 and the circuit 3 are switched at the level equal to or smaller than the provided voltage value, counterelectromotive force generated by the inductor 18 can be minimized, whereby it is possible to prevent that the circuit elements (especially FET and control IC 20) are destroyed.

Further, since the connections between the halogen heaters 1 and 2 and the constant voltage output circuit 3 are switched by using the TRIACs 4 and 5, an operational noise can be decreased as compared with a case of using a magnetic relay. Further, if the switching is performed by using an FET, the FET of which on-resistance is small is used to suppress heat generation, thereby increasing manufacturing costs.

However, if the TRIACs 4 and 5 are used, it becomes possible to decrease the manufacturing costs.

In the present invention, the same effect as above can be obtained even if thyristors are used instead of the TRIACs 4 and 5.

Figure 4:
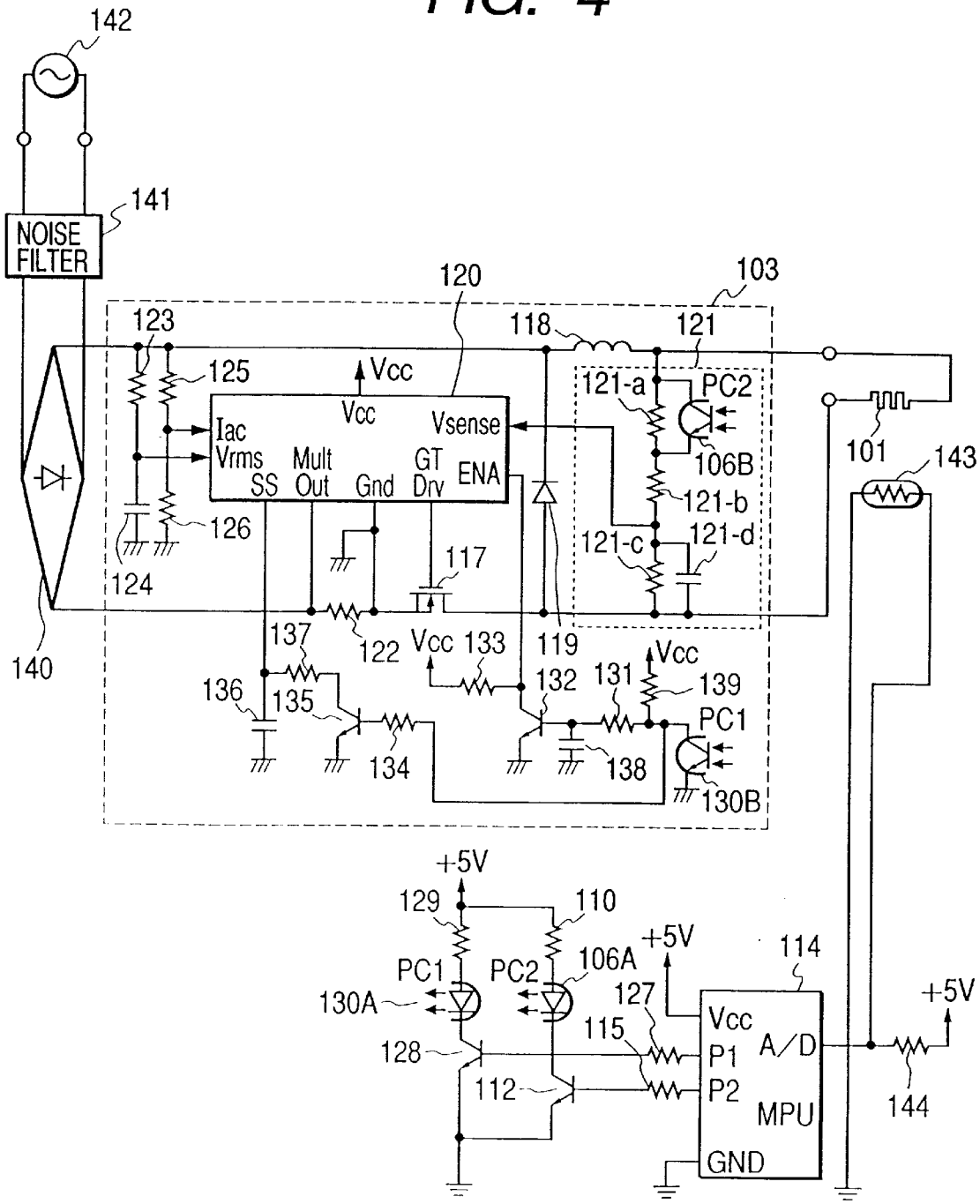
FIG. 4 is a block diagram indicating a second embodiment of the present invention.

FIG. 4 shows a heater control circuit of the image process apparatus according to a second embodiment of the present invention.

In FIG. 4, a halogen heater 101 acts as a heating means in the thermal fixing apparatus such as a copy machine, a laser printer or the like. Power is supplied to the halogen heater 101 from a later-described constant voltage output circuit 103. The constant voltage output circuit 103 includes a chopping FET 117, an inductor 118 and a snubber diode 119, and forms a voltage dropping type DC/DC converter.

Numeral 120 denotes a control IC which is "UC3854" manufactured by UNITRODE in the drawing. An output voltage to the heater 101 is detected by a voltage detection circuit 121 and an output current to the heater 101 is detected by a current detection resistor 122. An input voltage effective value to the control IC 120 is detected by a resistor 123 and a capacitor 124, and an input voltage waveform is detected by resistors 125 and 126 respectively to perform controlling such that the output voltage to the halogen heater 101 has a constant value. Also, the IC 120 controls a duty of the chopping FET 117 repeating on and off at cycle of about 100 KHz such that the output voltage from the constant voltage output circuit 103 becomes constant or that an output current waveform and the input voltage waveforms become similar.

The MPU 114 turns on a transistor 128 through a resistor 127 by setting a digital output port (P1) to have a high level. Then, a photodiode 130A of a photocoupler connected to a power supply of +5V through a pull-up resistor 129 is turned on and a phototransistor 130B is turned on. Then, a power supply voltage (Vcc) is inputted to an enable terminal (ENA) of the control IC 120 through a resistor 133 by turning off a transistor 132 through a resistor 131. Therefore, the control IC 120 controls a constant voltage output. When an output from the phototransistor 130 is in an ON state, a transistor 135 is turned off simultaneously through a resistor 134, a capacitor 136 connected to a soft start terminal (SS) is charged and potential of the soft start terminal (SS) is raised gradually. Therefore, the output voltage of the constant voltage output circuit 103 is also raised in a certain time constant. On the contrary, when an output from the transistor 130B is in an OFF state, since the transistor 135 becomes ON, electrical charge in the charged capacitor 136 is discharged through a resistor 137. Therefore, the potential in the soft start terminal (SS) is gradually fallen, and the output voltage of the constant voltage output circuit 103 is also fallen in a certain time constant.

A capacitor 138 connected to a base of the transistor 132 operates such that the transistor 132 used in enable controlling is made to be turned on and off in a certain delay time to the transistor 135 used in a soft start controlling when the phototransistor 130B is turned on and off. A resistor 139 is a pull-up resistor which causes the transistors 132 and 135 to be turned on.

The constant voltage output circuit 103 is connected to a commercial power supply 142 through a diode bridge 140 and a noise filter 141.

An MPU 114 detects temperature of the thermal fixing apparatus including the halogen heater 101, by using a thermistor 143 and a resistor 144 acting as temperature detection elements. The temperature of the thermal fixing apparatus is set to become a target value by controlling the output from the constant voltage output circuit 103 on the basis of the detected temperature.

In an output voltage detection circuit 121, the output voltage is divided at a predetermined voltage division ratio using resistors 121*a*, 121*b* and 121*c* to input the divided voltage into the control IC 120. A phototransistor 106B is connected to both terminals of the resistor 121*a*. An anode at a side of a photodiode 106A, which makes a pair with the phototransistor 106B, is connected to a power supply of +5V through a resistor 110. A cathode thereof is connected to a transistor 112.

In the MPU 114, which includes a timer, a ROM, a RAM, each input/output port (not shown) and the like used in performing lighting controlling of the heaters, a digital output port P2 is connected to a base of the transistor 112 through a resistor 115. The transistor 112 is turned on by making the output port P2 becomes a high level. Then, the photodiode 106A is turned on and the phototransistor 106B is turned on. Therefore, the resistor 121*a* is short circuited to be resulted in that the voltage division ratio is varied, thereby varying a detection voltage to be inputted to the control IC 120.

Figure 5:
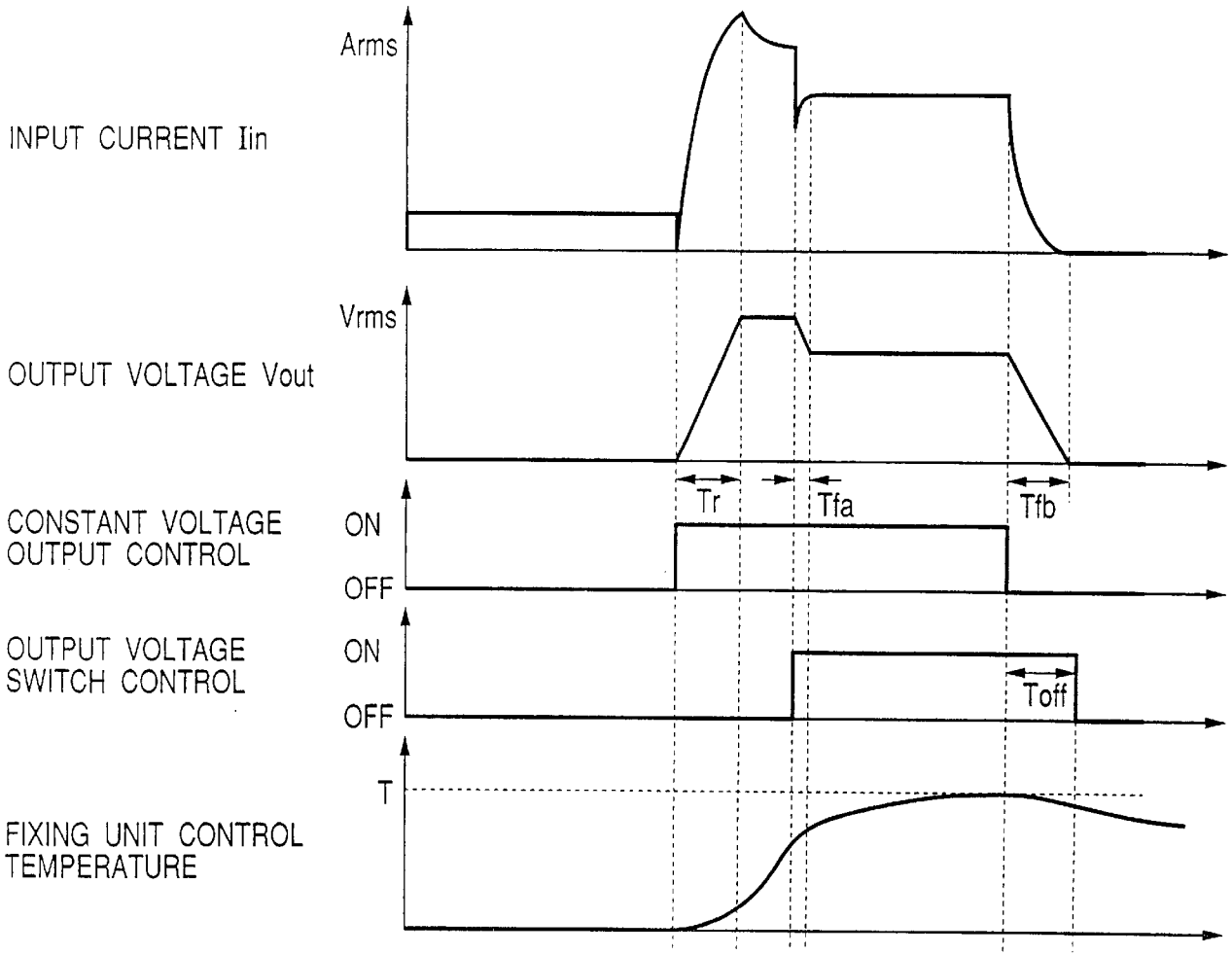
FIG. 5 is a timing chart indicating an operation in the second embodiment of the present invention.

Subsequently, controlling at a time when the halogen heater is turned on and off will be described with reference to a timing chart shown in FIG. 5. FIG. 5 shows each controlling, an output voltage Vout of the constant voltage output circuit 103 and an input current Iin from the commercial power supply 142 when the heater 101, which is in an OFF state, is turned on. Then, the output voltage is switched, and the heater 101 is turned off.

At first, in a case where the heater 101, which is in the OFF state, is turned on, since the constant voltage output circuit 103 is set up in a certain time constant depending on a slow start function after starting constant voltage output controlling, the input current Iin is also raised gradually. After elapsing a predetermined time, the MPU 114 switches the output voltage of the output voltage detection circuit 121 (i.e., voltage division ratio) by setting the port P2 to have a high level to vary an output voltage value of the constant voltage output circuit 103.

Off timing of a control signal concerning output voltage switch controlling is to be set after elapsing a time Tfb from when a control signal concerning a constant voltage output controlling is turned off until when the output voltage Vout becomes zero (Toff>Tfb).

Figure 6:
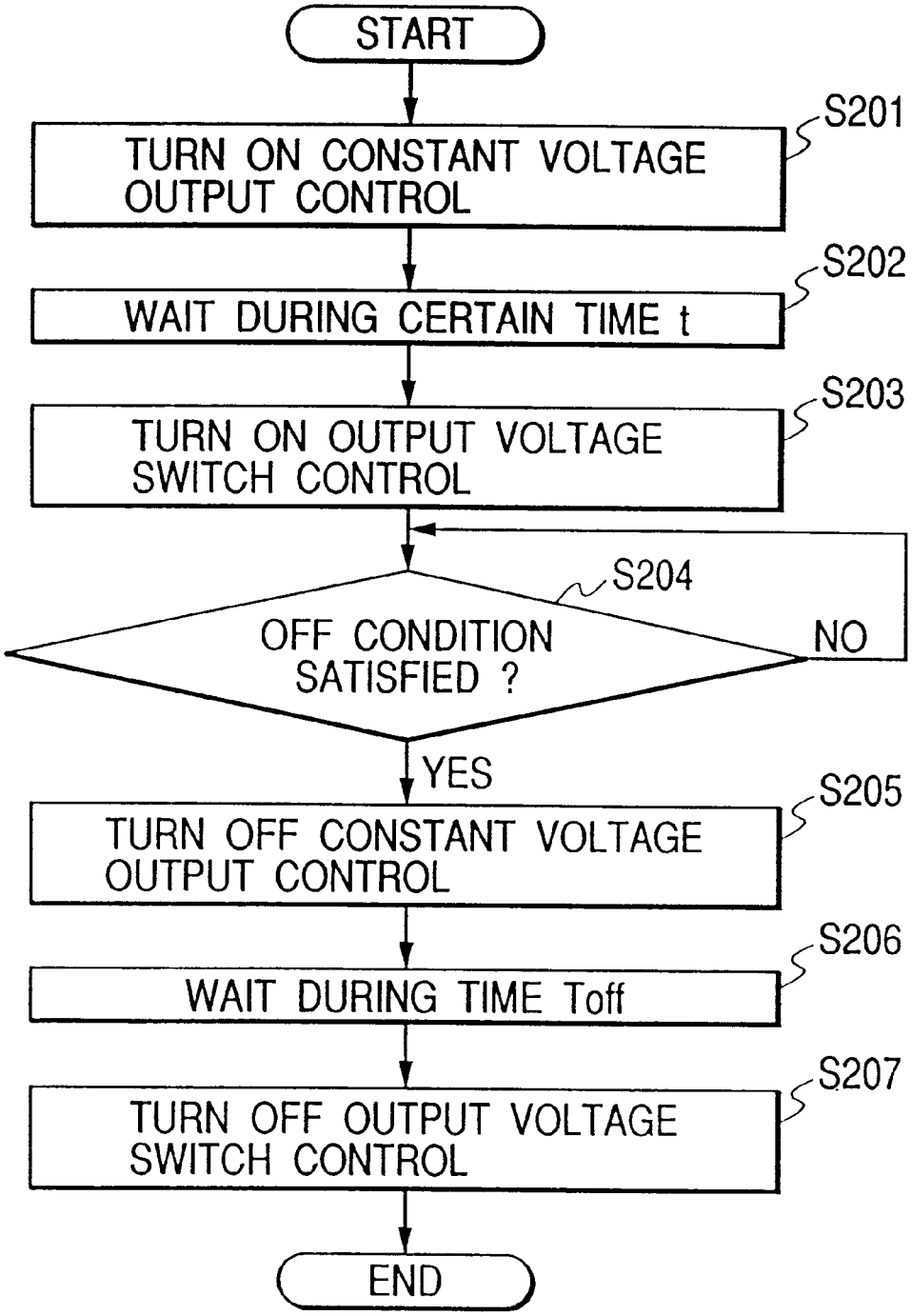
FIG. 6 is a flow chart indicating a control procedure in the second embodiment of the present invention.

FIG. 6 is a flow chart indicating a control procedure in a circuit shown in FIG. 4.

At first, in a case where it is determined to light the heater 101, the constant voltage output circuit 103 is to be driven to turn on an output (S201). Then, after elapsing a predetermined time t (determined depending on heater power, heat capacity of fixing unit, or the like) (S202), switching controlling of the output voltage is performed (S203). If an off condition previously defined is satisfied (S204), the constant voltage output controlling is turned off (S205) and a constant voltage output switch controlling is turned off (S207) after elapsing the time Toff (S206).

As described above, the heater 101 can be fast warmed up by switching the voltage supplied to the heater 101, i.e., by supplying the voltage higher than that in an ordinary state at a lighting initial state of the heater 101. Thus, it becomes possible to shorten a waiting time in a printer or the like. Also, it becomes possible to prevent destruction of the control IC 20 or the FET 17 by turning off the constant voltage output controlling when the heater 101 is in an OFF state.

Figure 7:
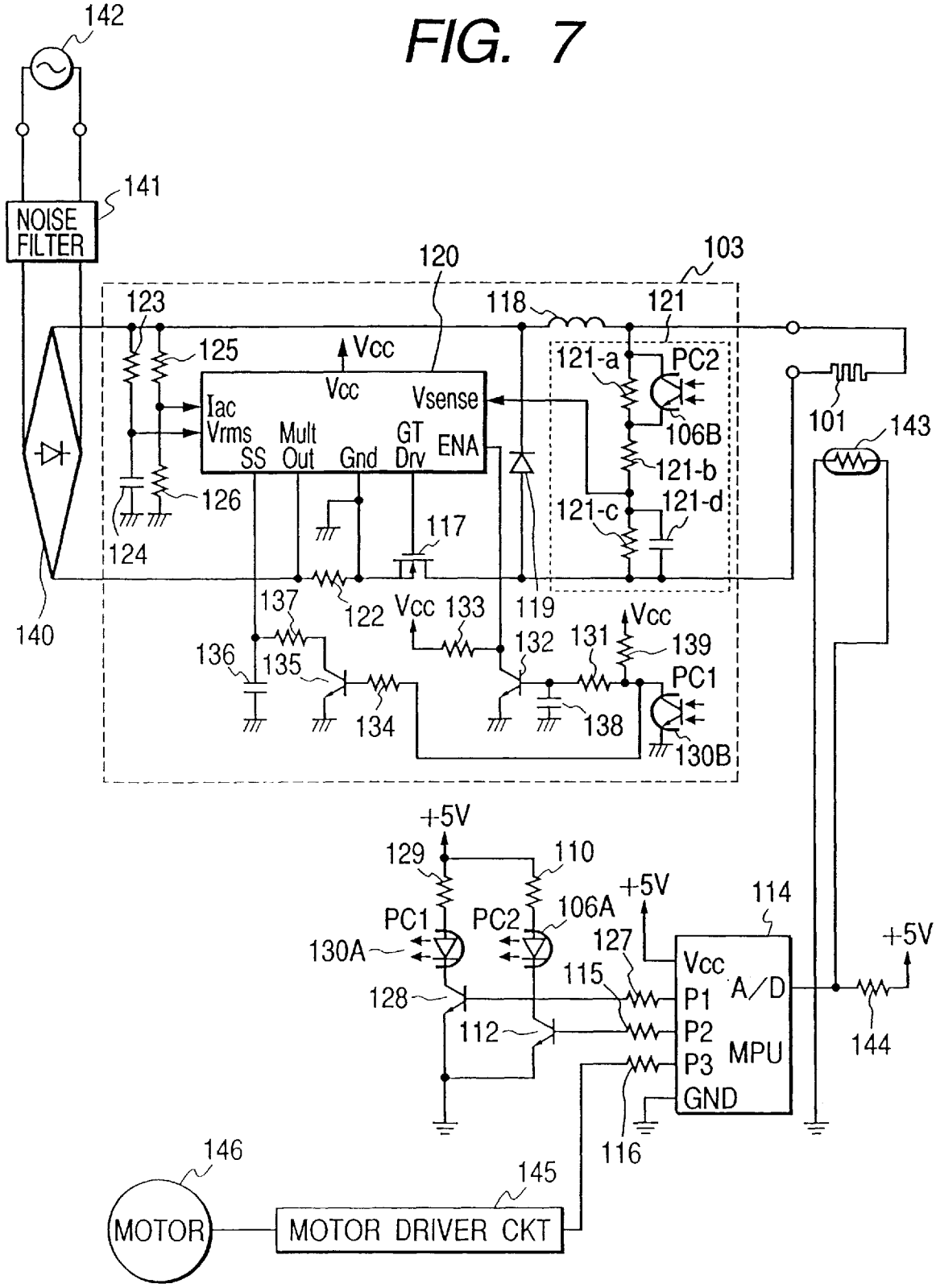
FIG. 7 is a block diagram indicating a third embodiment of the present invention.

FIG. 7 is a block diagram showing a third embodiment applied to the present invention. In FIG. 7, it should be noted that the parts same as those shown in FIG. 4 are added with same numerals and symbols.

The embodiment shown in FIG. 7 is different from that shown in FIG. 4 in the point that a power supply load (e.g., motor) and a drive circuit thereof are added. A motor drive circuit 145 is to be operated by activating a digital output port P3 of the MPU 114 to drive a motor 146.

Figure 8:
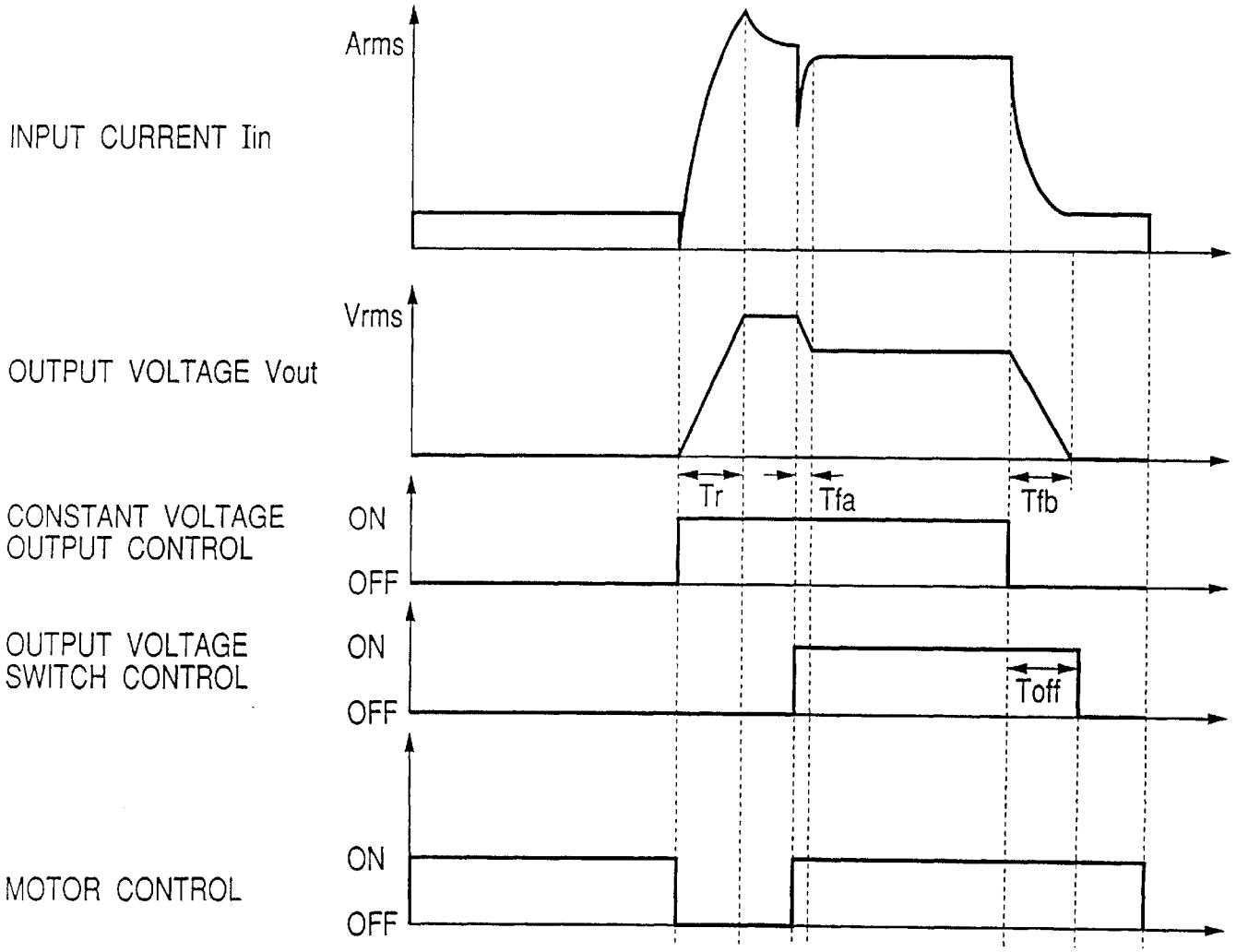
FIG. 8 is a timing chart indicating an operation in the third embodiment of the present invention.

Subsequently, a control procedure at a time when the heater 101 is turned on and off will be described with reference to a timing chart shown in FIG. 8. Like the second embodiment shown in FIG. 5, the timing chart shown in FIG. 8 shows respective controlling in the OFF state of the heater 101, the turning on of the heater 101, the switching of the output voltage, and then the turning off of the heater 101. Also, FIG. 8 shows the output voltage Vout of the constant voltage output circuit 103 and the input current Iin from the commercial power supply. Then, the output voltage is switched, and the heater 101 is turned off.

A point in FIG. 8 different from that shown in FIG. 5 is that on/off controlling of the power supply load (e.g., motor) is added. That is, before lighting the heater 101, driving of the motor 146 is stopped to switch a constant voltage output to the heater 101 to suppress a load current or, at the same time, the motor 146 is driven after elapsing a predetermined time. It should be noted that the motor 146 may be driven at low speed.

Figure 9:
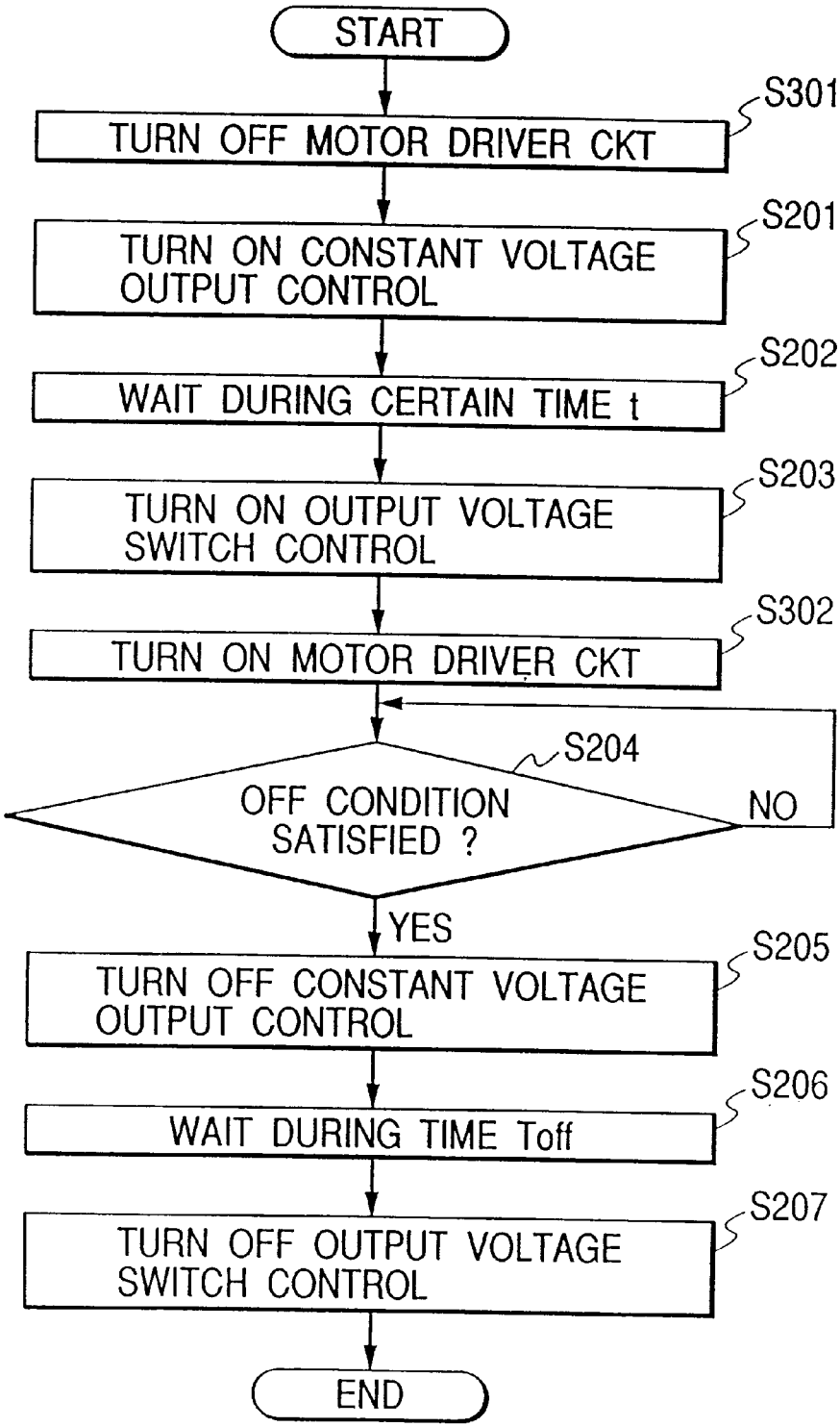
FIG. 9 is a flow chart indicating a control procedure in the third embodiment of the present invention.

Subsequently, controlling in the embodiment of the present invention will be described with reference to a flow chart in FIG. 9. A point in FIG. 9 different from that in FIG. 6 according to the above second embodiment is that the motor drive circuit 145 is turned off (S301). Then, the heater is lighted to switch the output voltage (S201 to S203). Thereafter, the motor drive circuit is turned on (S302) to stop to light the heater 101 (S204 to S207) in case of satisfying an off condition of the heater 101.

By performing the above controlling, it becomes possible to warm up the fixing unit (not shown) fast by lighting the heater 101 at the voltage higher than that in the ordinary state at the initial time of lighting the heater 101 and to prevent or suppress the power consumption in case of supplying high voltage to the heater.

The present invention is not limited to the above embodiments. That is, various modifications are possible within the spirit and scope of the appended claims.

What is claimed is:

1. A control device for a heater drive apparatus, comprising:

a constant voltage output circuit for outputting constant voltage;

first and second power control elements for supplying the constant voltage output from said constant voltage output circuit respectively to first and second heaters, or interrupting the constant voltage output from said voltage output circuit supplied respectively to said first and second heaters;

a temperature sensor for detecting a temperature of an object heated by said first and second heaters; and control means for controlling the operations of said first and second power control elements on the basis of an output from said temperature sensor, so as to maintain the temperature of the object to a target temperature, wherein, when one of said first and second heaters is kept ON and the other of said heaters is changed from ON to OFF, said control means stops the operation of said constant voltage output circuit, then changes the other of said heaters to OFF, and operates said constant voltage output circuit.

2. A device according to claim 1, wherein said power control element is a thyristor or a TRIAC.

3. A device according to claim 1, wherein, when said constant voltage output control circuit stops operating, said circuit gradually decreases the output voltage.

4. A control method for a heater drive apparatus which drives first and second heaters by an identical constant voltage output circuit, comprising the steps of:

(a) detecting a temperature of an object heated by the first and second heaters;

(b) judging whether or not one of the first and second heaters is to be ON/OFF on the basis of the temperature detected in said detecting step (a), so as to maintain the temperature of the object to a target temperature;

(c) judging whether or not the constant voltage output circuit is in the constant voltage output control, when one of the first and second heaters is changed from ON to OFF;

(d) once stopping the constant voltage output control if the constant voltage output circuit is in the constant voltage output control;

(e) changing one of the heaters to OFF after stopping the constant voltage output control;

(f) judging whether or not the other of the first and second heaters is changed to OFF after changing one of the heaters to OFF; and (g) restarting the constant voltage output control of the constant voltage output circuit, if the other of the heaters is not changed to OFF.

5. A method according to claim 4, wherein, when the constant voltage output circuit stoops the constant voltage control, the circuit generally decreases the output voltage.

6. A control device of a heater drive apparatus, comprising:

a detection circuit for detecting a voltage supplied to a heater;

a constant voltage output control circuit for performing control such that the voltage detected by said detection circuit has a constant value;

a temperature detection circuit for detecting a temperature of an object heated by the heater; and a control circuit for switching ON and OFF states of the heater in accordance with the temperature detected by said temperature detection circuit, so as to maintain the temperature of the object to a target temperature, wherein said control circuit gradually raises an output voltage of said constant voltage output control circuit to a state higher than an ordinary state at a time when said switch circuit starts switching the heater from the OFF state to the ON state, and then returns the output voltage of said constant voltage output control circuit to an ordinary state.

7. A device according to claim 6, further comprising a drive circuit having a load different from the heater, and wherein said control circuit stops said drive circuit driving the load when the output voltage of said constant voltage output control circuit is raised.

* * * * *

UNITED STATES PATENT AND TRADEMARK OFFICE

CERTIFICATE OF CORRECTION

PATENT NO. : 6,093,916

DATED : July 25, 2000

INVENTOR(S): KIYOTO TOYOIZUMI

It is certified that error appears in the above-identified patent and that said Letters Patent is hereby corrected as shown below:

COLUMN 4:
Line 64, "Sill," should read --S111--.

COLUMN 8:
Line 57, "stoops" should read --stops--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*